US012742281B2

(12) United States Patent
Yoo et al.

(10) Patent No.: US 12,742,281 B2
(45) Date of Patent: Sep. 22, 2026

(54) CLOTHES DRYER AND METHOD FOR CONTROLLING THE SAME

(71) Applicant: SAMSUNG ELECTRONICS CO., LTD., Suwon-si (KR)

(72) Inventors: Sangoh Yoo, Suwon-si (KR); Gawon Lee, Suwon-si (KR); Injoo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 955 days.

(21) Appl. No.: 18/058,202

(22) Filed: Nov. 22, 2022

(65) Prior Publication Data

US 2023/0235499 A1 Jul. 27, 2023

Related U.S. Application Data

(63) Continuation of application No. PCT/KR2022/015088, filed on Oct. 7, 2022.

(30) Foreign Application Priority Data

Jan. 26, 2022 (KR) ..... 10-2022-0011726

(51) Int. Cl.
*D06F 58/38* (2020.01)
*D06F 101/04* (2020.01)
(Continued)

(52) U.S. Cl.
CPC ..... *D06F 58/38* (2020.02); *D06F 2101/04* (2020.02); *D06F 2101/14* (2020.02);
(Continued)

(58) Field of Classification Search
CPC .. D06F 58/38; D06F 2101/04; D06F 2101/14; D06F 2101/16; D06F 2103/08;
(Continued)

(56) References Cited

U.S. PATENT DOCUMENTS 5,347,727 A 9/1994 Kim
5,682,684 A 11/1997 Wentzlaff et al.
(Continued)

FOREIGN PATENT DOCUMENTS

CN 1773007 A 5/2006
DE 4243594 A1 7/1993
(Continued)

OTHER PUBLICATIONS

Supplementary European Search Report dated Dec. 11, 2024, in connection with European Patent Application No. 22924317.5, 10 pages.
(Continued)

*Primary Examiner* — Jessica Yuen

(57) ABSTRACT

A clothes dryer comprises a drum, a weight detection sensor, a moisture content detection sensor, and a controller. The controller is configured to determine a category for the drying item among a plurality of categories based on the weight of the drying item detected by the weight detection sensor and the residual moisture content information about the drying item obtained by the moisture content detection sensor at a first predetermined time after an initial drying cycle is initiated according to an initial control condition, monitor a reduction state in the residual moisture content information about the drying item obtained by the a moisture content detection circuit based on a reference time and a moisture content threshold defined corresponding to the determined category to determine a drying level for the drying item, and then initiate a main drying cycle according to the control condition corresponding to the determined drying level.

19 Claims, 8 Drawing Sheets

500

| | INITIAL MOISTURE CONTENT | INITIAL WEIGHT INFORMATION | |
|---|---|---|---|
| | | WEIGHT >= 500 | WEIGHT < 500 |
| 512 | 1200 >= MOISTURE CONTENT >= 1000 | 1 | 5 |
| 514 | 1000 >= MOISTURE CONTENT >= 800 | 2 | 6 |
| 516 | 800 >= MOISTURE CONTENT >= 200 | 3 | 7 |
| 518 | 200 >= MOISTURE CONTENT >= 0 | 4 | 8 |
| | | 502 | 504 |

(51) Int. Cl.

| | |
|---|---|
| ***D06F 101/14*** | (2020.01) |
| ***D06F 101/16*** | (2020.01) |
| ***D06F 103/08*** | (2020.01) |
| ***D06F 103/32*** | (2020.01) |

(52) U.S. Cl.
CPC ..... *D06F 2101/16* (2020.02); *D06F 2103/08* (2020.02); *D06F 2103/32* (2020.02)

(58) Field of Classification Search
CPC ..... D06F 2103/32; D06F 2105/26; D06F 2105/52; D06F 34/18; D06F 58/206; D06F 58/48; D06F 2103/04; D06F 2105/12
See application file for complete search history.

(56) References Cited

U.S. PATENT DOCUMENTS

| | | | |
|---|---|---|---|
| 10,161,078 | B2 | 12/2018 | Xu et al. |
| 10,494,757 | B2 | 12/2019 | Xu et al. |
| 11,447,910 | B2 | 9/2022 | Choi et al. |
| 2008/0216517 | A1 | 9/2008 | Chung |
| 2016/0222576 | A1 | 8/2016 | Yoo et al. |
| 2019/0153658 | A1 | 5/2019 | Je et al. |
| 2020/0024794 | A1 | 1/2020 | Pattarello et al. |
| 2021/0140092 | A1 | 5/2021 | Je et al. |
| 2021/0156073 | A1 | 5/2021 | Kim |
| 2022/0220662 | A1 | 7/2022 | Yoo et al. |

FOREIGN PATENT DOCUMENTS

| | | | | |
|---|---|---|---|---|
| EP | 719885 | B1 | 9/1999 | |
| EP | 1103648 | A2 | 5/2001 | |
| EP | 1852542 | A1 | 11/2007 | |
| EP | 2468950 | A1 | 6/2012 | |
| EP | 2516719 | B1 | 11/2013 | |
| EP | 2840179 | A1 | 2/2015 | |
| EP | 3239390 | A1 * | 11/2017 | ..... D06F 58/48 |
| EP | 3492648 | A1 | 6/2019 | |
| JP | 2010042118 | A | 2/2010 | |
| JP | 2011193902 | A | 10/2011 | |
| JP | 5501091 | B2 | 5/2014 | |
| JP | 6937135 | B2 | 9/2021 | |
| KR | 10-2008-0081755 | A | 9/2008 | |
| KR | 10-2009-0107849 | A | 10/2009 | |
| KR | 10-2011-0122463 | A | 11/2011 | |
| KR | 20170115091 | A | 10/2017 | |
| KR | 10-2019-0127439 | A | 11/2019 | |
| KR | 10-2021-0027904 | A | 3/2021 | |
| KR | 10-2021-0062210 | A | 5/2021 | |
| KR | 102408516 | B1 | 6/2022 | |
| KR | 20230102608 | A | 7/2023 | |
| WO | 2021215853 | A1 | 10/2021 | |
| WO | 2021241916 | A1 | 12/2021 | |

OTHER PUBLICATIONS

International Search Report and Written Opinion of the International Searching Authority dated Jan. 18, 2023, in connection with International Application No. PCT/KR2022/015088, 6 pages.
Office Action issued Jul. 2, 2026, in connection with Chinese Patent Application No. 202280069389.8, 18 pages.
Office Action issued on Aug. 10, 2026, in the Korean Patent Application No. 10-2022-0011726, 15 pages.

* cited by examiner

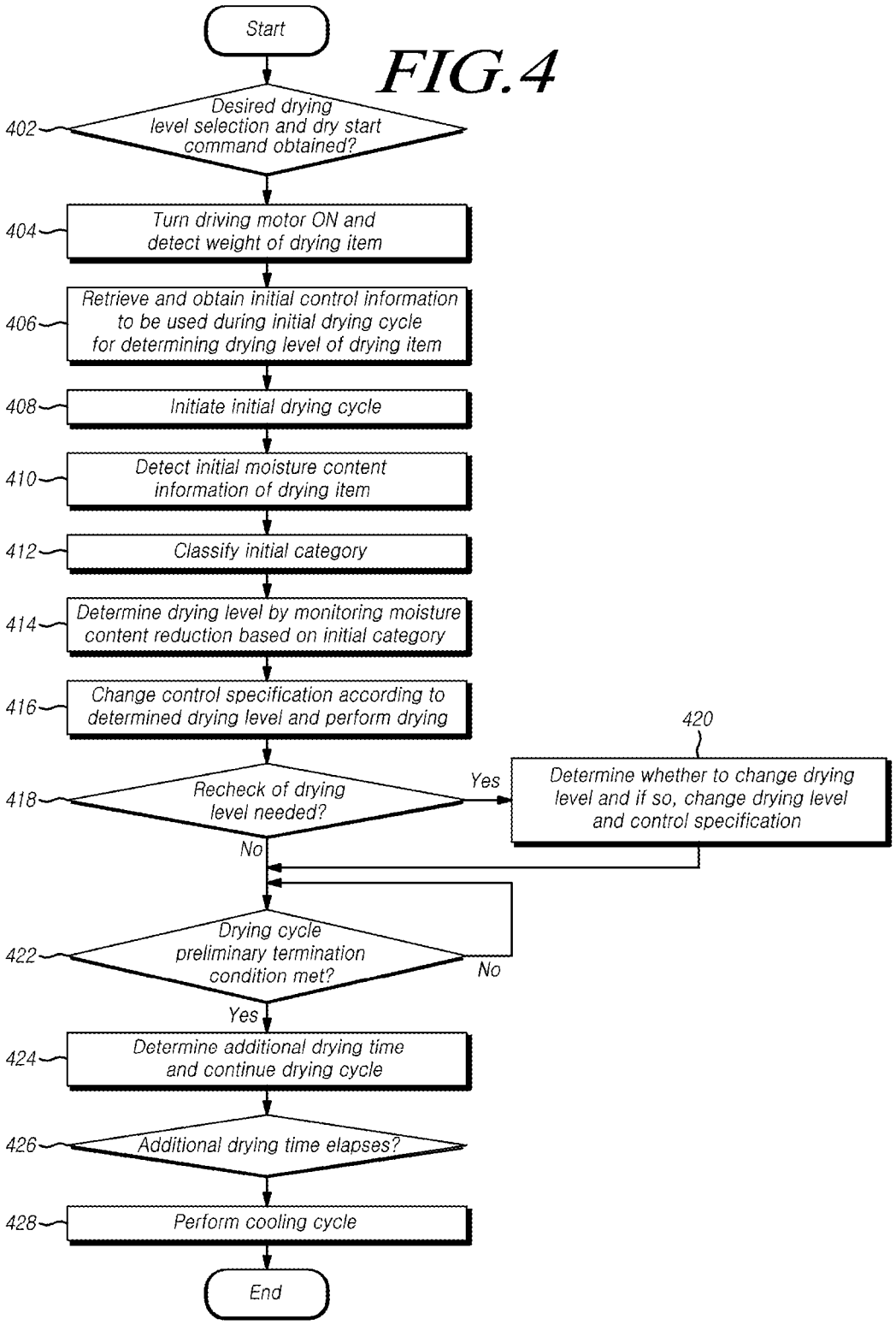
FIG. 4
Start
402
Desired drying level selection and dry start command obtained?
404
Turn driving motor ON and detect weight of drying item
406
Retrieve and obtain initial control information to be used during initial drying cycle for determining drying level of drying item
408
Initiate initial drying cycle
410
Detect initial moisture content information of drying item
412
Classify initial category
414
Determine drying level by monitoring moisture content reduction based on initial category
416
Change control specification according to determined drying level and perform drying
418
Recheck of drying level needed?
Yes
420
Determine whether to change drying level and if so, change drying level and control specification
No
422
Drying cycle preliminary termination condition met?
No
Yes
424
Determine additional drying time and continue drying cycle
426
Additional drying time elapses?
428
Perform cooling cycle
End

FIG.5

500

| | INITIAL MOISTURE CONTENT | INITIAL WEIGHT INFORMATION | |
|---|---|---|---|
| | | WEIGHT >= 500 | WEIGHT < 500 |
| 512 | 1200 >= MOISTURE CONTENT >= 1000 | 1 | 5 |
| 514 | 1000 >= MOISTURE CONTENT >= 800 | 2 | 6 |
| 516 | 800 >= MOISTURE CONTENT >= 200 | 3 | 7 |
| 518 | 200 >= MOISTURE CONTENT >= 0 | 4 | 8 |
| | | 502 | 504 |

FIG. 7

| INITIAL CATEGORY | HIGH-LOAD DRYING LEVEL | LOW-LOAD DRYING LEVEL | SPECIAL LOAD DRYING LEVEL |
|---|---|---|---|
| 1 | LEVEL 5 | LEVEL 4 | LEVEL 3 |
| 2 | LEVEL 4 | LEVEL 3 | LEVEL 2 |
| 3 | LEVEL 3 | LEVEL 2 | |
| 4 | LEVEL 2 | LEVEL 2 | |
| 5 | LEVEL 5 | LEVEL 4 | |
| 6 | LEVEL 3 | LEVEL 2 | |
| 7 | LEVEL 3 | LEVEL 2 | |
| 8 | LEVEL 1 | LEVEL 1 | |

CLOTHES DRYER AND METHOD FOR CONTROLLING THE SAME

CROSS-REFERENCE TO RELATED APPLICATIONS

This application is a bypass continuation application of International Application No. PCT/KR2022/015088 filed on Oct. 7, 2022, which claims priority to Korean Patent Application No. 10-2022-0011726, filed on Jan. 26, 2022, in the Korean Intellectual Property Office, the disclosures of which are hereby incorporated by in their entireties.

BACKGROUND

1. Field

The disclosure relates to a clothes dryer, and more particularly, to a clothes dryer capable of providing an optimized drying process according to the characteristics of clothes as a drying item, such as the total load and characteristics of the material, and a method for controlling the same.

2. Description of Related Art

A clothes dryer is a device for drying an object by supplying hot air into the drum containing various objects, including clothes, towels, and blankets of various materials while rotating the drum. Typically, the clothes dryer is operated to dry drying items based on each drying time and temperature determined by the user's option selection (e.g., basic course, shirt course, jeans course, delicate fiber course, or small load course) made before starting the drying cycle. Hence, the user is required to figure out the characteristics of the drying items and select an appropriate option whenever drying on the clothes dryer.

SUMMARY

Depending on the characteristics of a drying item, such as total weight, dehydration degree, or material composition, the drying temperature or time appropriate for the drying item may significantly differ. If the drying process is performed for a drying time that is not suitable for the drying item, the drying cycle may be finished without the drying item being completely dried, or power loss may occur due to excessive drying cycle progress. If the drying process is performed at a temperature that is not suitable for the drying item, damage to the material/shape change due to excessive heat or incomplete drying may occur. If the user has to select an option that provides an appropriate drying time and temperature by identifying the characteristics of each drying item whenever performing drying, it may be burdensome or tricky to the user.

The present disclosure discloses a clothes dryer and a method for controlling the same, which may quickly determine the optimal drying level for the drying item based on the weight of the drying item put into the drum and the reduction state of the residual moisture content in the initial stage after the start of a drying cycle and accordingly provide an optimized drying cycle.

Further, the present disclosure discloses a clothes dryer and a method for controlling the same, which may monitor the reduction state of the residual moisture content of the drying item over a plurality of steps after the start of a drying cycle and provide a drying cycle under conditions optimized for the characteristics of the drying item.

According to an aspect of the disclosure, a clothes dryer may comprise a drum configured to receive a drying item, a weight detection sensor configured to detect a weight of the drying item in the drum, a moisture content detection circuit configured to obtain residual moisture content information about the drying item in the drum, and a controller configured to determine a category for the drying item among a plurality of categories based on the weight of the drying item detected by the weight detection sensor and the residual moisture content information about the drying item obtained by the moisture content detection circuit at a first predetermined time after an initial drying cycle is initiated according to an initial control condition, monitor a reduction state in the residual moisture content information about the drying item obtained by a moisture content detection circuit based on a reference time and a moisture content threshold defined corresponding to the determined category to determine a drying level for the drying item, and then initiate a main drying cycle according to a control condition corresponding to the determined drying level.

According to another aspect of the disclosure, a method for controlling a drying operation of a clothes dryer including a drum configured to receive a drying item, a weight detection sensor configured to detect a weight of the drying item in the drum, a moisture content detection circuit configured to obtain residual moisture content information about the drying item in the drum, and a heat pump system including a compressor may comprise determining a category for the drying item among a plurality of categories based on the weight of the drying item detected by the weight detection sensor and the residual moisture content information about the drying item obtained by the a moisture content detection circuit at a predetermined time after an initial drying cycle is initiated according to an initial control condition, monitoring a reduction state in the residual moisture content information about the drying item obtained by the a moisture content detection circuit based on a reference time and a moisture content threshold defined corresponding to the determined category to determine a drying level for the drying item, and controlling an operation of the compressor according to an operation condition of the compressor corresponding to the determined drying level to initiate a main drying cycle.

According to various embodiments of the disclosure, the clothes dryer may provide drying at an appropriate temperature and time matching the characteristics of respective drying items even without the user's intervention, enhancing user convenience. According to various embodiments of the disclosure, the clothes dryer may figure out the characteristics of the drying items put in the drum automatically and quickly after a drying cycle starts and provide a drying cycle optimized for the drying items based on the characteristics, minimizing damage to the clothes and enhancing the drying quality without power waste.

The effects that can be obtained from the present disclosure are not limited to those described above, and any other effects not mentioned herein will be clearly understood by those having ordinary knowledge in the technical field to which the present disclosure belongs from the description below.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The above and other objects, features, and advantages of the present disclosure will be more clearly understood from the following detailed description, taken in conjunction with the accompanying drawings, in which:

FIG. 4 is a flowchart schematically illustrating an overall process for drying a drying item according to an optimized drying mode by a condenser clothes dryer 100 under the control of the controller 230 of FIG. 3 according to an embodiment of the disclosure;

FIG. 5 is a table including threshold information defining each of a plurality of initial categories, used to determine an initial category in the process of determining a drying level optimized for a drying item according to an optimized drying mode in the condenser clothes dryer 100 of FIG. 1 according to an embodiment of the disclosure;

FIG. 7 is a table including each of a high load drying level, a low load drying level, and/or a special load drying level defined per initial category for a drying item according to an embodiment of the disclosure.

DETAILED DESCRIPTION

Figure 1:
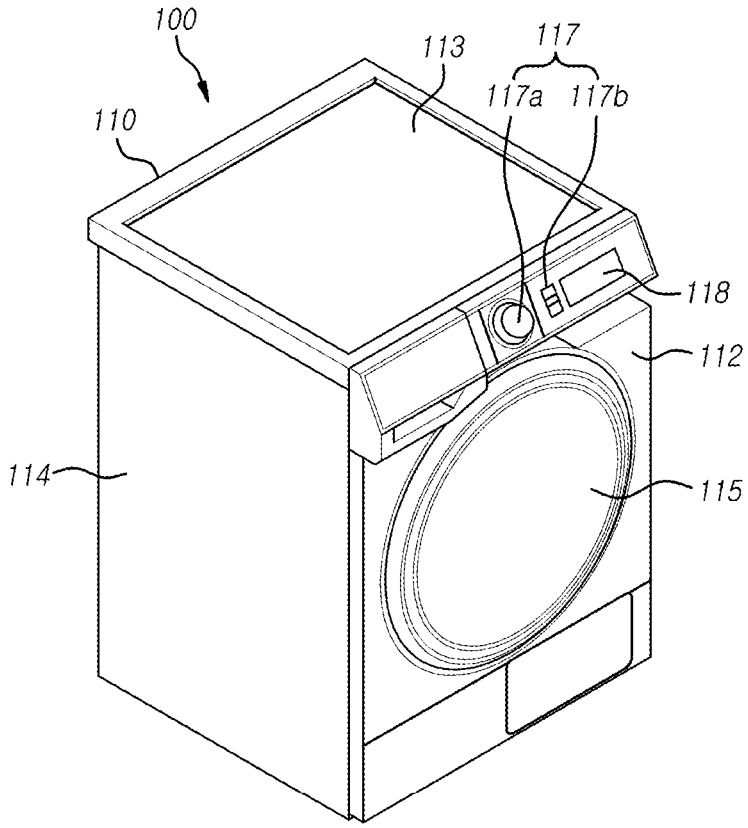
FIG. 1 is a perspective view illustrating an outer appearance of a condenser clothes dryer 100 according to an embodiment of the disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments of the present disclosure are now described with reference to the accompanying drawings in such a detailed manner as to be easily practiced by one of ordinary skill in the art. However, the present disclosure may be implemented in other various forms and is not limited to the embodiments set forth herein. The same or similar reference denotations may be used to refer to the same or similar elements throughout the specification and the drawings. Further, for clarity and brevity, no description is made of well-known functions and configurations in the drawings and relevant descriptions.

Figure 2:
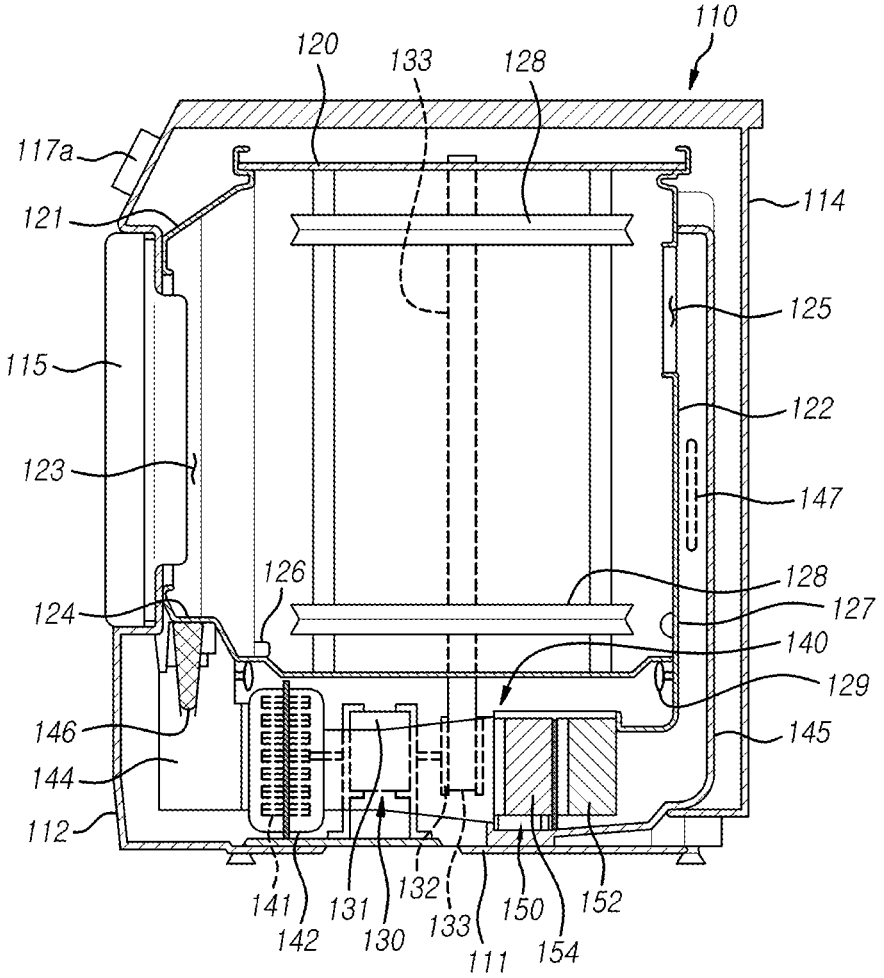
FIG. 2 is a side cross-sectional view illustrating the condenser clothes dryer 100 of FIG. 1.

FIG. 1 is a perspective view illustrating an outer appearance of a condenser clothes dryer 100 according to an embodiment of the disclosure. FIG. 2 is a side cross-sectional view illustrating the condenser clothes dryer 100 of FIG. 1.

Referring to FIGS. 1 and 2, a condenser clothes dryer 100 according to an embodiment of the disclosure may include a housing 110 forming an outer appearance of the condenser clothes dryer 100, a drum 120 rotatably disposed in the housing 110 and configured to receive a drying item, a drum driver 130 driving the drum 120 to rotate, an air circulation flow path 140 guiding air discharged from an inside of the drum 120 back to be introduced back into the inside of the drum 120, and a heat pump system 150 removing moisture from the air passing through the air circulation flow path 140 and applying heat.

According to an embodiment of the disclosure, the housing 110 may have a substantially hexahedral shape, but the disclosure is not limited thereto. According to various embodiments of the disclosure, the housing 110 may include a base plate 111, a front cover 112, a top cover 113, and a side/rear cover 114. According to various embodiments of the disclosure, the front cover 112 may include an opening formed in the center. A door 115 may be rotatably installed on the front cover 112 in a position corresponding to the opening. According to various embodiments of the disclosure, the opening on the front cover 112 may be opened or closed by opening and closing the door 115.

According to various embodiments of the disclosure, an input unit 117 for receiving control inputs from the user and a display 118 for displaying a screen for guiding the user's input or various pieces of information regarding the operation of the condenser clothes dryer 100 may be disposed at the upper end of the front cover 112 of the housing 110. According to an embodiment of the disclosure, as shown in FIG. 1, the input unit 117 may include at least one input unit among a jog shuttle or dial-type input unit 117*a*, which may be gripped and rotated by the user, and a touch pad or key/button-type input unit 117*b*, but the disclosure is not limited thereto. According to an embodiment of the disclosure, a selection for a drying mode and/or a desired drying level may be received from the user through the input unit 117. According to an embodiment of the disclosure, a start/stop command of a drying cycle for a drying item may be received from the user through the input unit 117. According to an embodiment of the disclosure, the display 118 may include various types of display panels, such as an LCD, LED, OLED, QLED or micro LED, and have a touch pad on the front surface thereof to be implemented as a touchscreen, but the disclosure is not limited to a specific type of display. According to various embodiments of the disclosure, various operation states and user manipulation states of the condenser clothes dryer 100 may be displayed through the display 118.

According to various embodiments of the disclosure, the drum 120 may have a cylindrical shape with open front and rear surfaces and horizontally disposed. According to various embodiments of the disclosure, the front surface and rear surface of the drum 120 may be rotatably supported by a front panel 121 and a rear panel 122, respectively, fixed to the housing 110. According to various embodiments of the disclosure, an open part 123 may be formed in positions corresponding to the above-described door 115 and opening in the front cover 112, in the center of the front panel 121. According to various embodiments of the disclosure, the opening of the front cover 112 and the open part 123 on the front panel 121 may be opened and closed together by opening and closing the above-described door 115. According to various embodiments of the disclosure, when the opening in the front cover 112 and the open part 123 are opened, the drying item may be put into the inside of the drum 120 or the drying item may be removed from the inside of the drum 120.

According to various embodiments of the disclosure, an exhaust port 124 may be formed on a lower side of the front panel 121. According to various embodiments of the disclosure, air from the inside of the drum 120 may be discharged to the outside of the drum 120 through the exhaust port 124.

According to various embodiments of the disclosure, on the rear panel 122 supporting the rear surface of the drum 120, a hot air inlet 125 for allowing hot dry air to flow into the drum 120 may be formed. According to various embodiments of the disclosure, high-temperature dry air may be introduced into the drum 120 from an air circulation flow path 140, which is described below, through the hot air inlet 125.

According to various embodiments of the disclosure, the drum 120 may include a moisture content detection sensor 126 for detecting the residual moisture content (or drying degree) of the drying item received therein. According to an embodiment of the disclosure, e.g., as illustrated in FIG. 2, the drum 120 may include the moisture content detection sensor 126 at a front lower side, e.g., close to the exhaust port 124, but the disclosure is not limited thereto. According to an embodiment of the disclosure, the moisture content detection sensor 126 may come into contact with the drying item inside the drum 120 and may, by the contact, detect the amount of residual moisture in the drying item. According to an embodiment of the disclosure, the moisture content detection sensor 126 may generate an electrical signal indicating the residual moisture content or drying degree of the drying item received in the drum 120. According to an embodiment of the disclosure, the moisture content detection sensor 126 may include two electrode sensors spaced apart from each other at a predetermined interval (in this case, the two electrode sensors may be plate bar-type touch electrode sensors, but the disclosure is not limited thereto). According to an embodiment of the disclosure, if the amount of the residual moisture in the drying item contacting the two electrode sensors constituting the moisture content detection sensor 126 increases, current may flow more smoothly, so that an electrical signal having a higher voltage or current value may be output from the moisture content detection sensor 126 while the residual moisture in the drying item reduces, current flow is not smooth so that an electrical signal with a low voltage and current value may be output. As such, according to an embodiment of the disclosure, the moisture content detection sensor 126 may output an electric pulse signal indicating the residual moisture content of the drying item received inside the drum 120.

According to various embodiments of the disclosure, the drum 120 may include a temperature sensor 127 for detecting the air temperature inside the drum 120. According to an embodiment of the disclosure, e.g., as illustrated in FIG. 2, the temperature sensor 127 may be disposed at a rear lower side of the drum 120, but the disclosure is not limited thereto. According to another embodiment of the disclosure, the temperature sensor 127 may be disposed, e.g., near the hot air inlet 125 through which high-temperature dry air flows into the drum 120 or in a predetermined position on a rear duct 145 to be described below, but the disclosure is not limited to the temperature sensor 127 in a specific position. Although not specifically shown in FIGS. 1 and 2, according to an embodiment of the disclosure, the condenser clothes dryer 100 may further include a drum discharge temperature sensor disposed near the exhaust port 124 to measure the temperature of the air discharged from the inside of the drum 120, but the disclosure is not limited thereto.

According to various embodiments of the disclosure, the drum 120 may include a plurality of lifters 128 protruding on the inner circumferential surface as shown in FIG. 2. According to various embodiments of the disclosure, the lifters 128 on the inner circumferential surface of the drum 120 may lift the drying item to elevate and drop the drying item while the drying cycle proceeds while the drum 120 rotates, thereby allowing the drying item to be evenly dried on several surfaces thereof. According to various embodiments of the disclosure, a roller 129 may be provided on the outer circumferential surface of the drum 120 to support the drum 120 to smoothly rotate, but the disclosure is not limited thereto.

According to various embodiments of the disclosure, the drum driver 130 may include a driving motor 131 disposed under the drum 120 inside the housing 110 and a driving pulley 132 connected to the driving motor 131 and receiving power from the driving motor 131 to rotate. According to various embodiments of the disclosure, the drum driver 130 may include a belt 133 to rotate the drum 120 while being rotated by the rotation of the driving pulley 132. According to various embodiments of the disclosure, the belt 133 may be installed to surround the outer circumferential surface of the driving pulley 132 and the outer circumferential surface of the drum 120 and, as the driving pulley 132 is rotated as the driving motor 131 is driven, the drum 120 may be rotated. According to various embodiments of the disclosure, the drum 120 may be rotated clockwise and/or counterclockwise as the driving motor 131 is driven.

According to various embodiments of the disclosure, the air circulation flow path 140 may include a blower fan 141 disposed on the air circulation flow path 140 to circulate air through the air circulation flow path 140 and a blower fan case 142 to receive the blower fan 141. According to various embodiments of the disclosure, the air circulation flow path 140 may include a front duct 144 connecting the exhaust port 124 on the side of the front panel 121 of the drum 120 and the blower fan 141 and a rear duct 145 connecting the downstream portion of the blower fan 141 to the hot air inlet 125 on the rear panel 122 of the drum 120.

According to an embodiment of the disclosure, as shown in FIG. 2, the blower fan 141 may be connected to the driving motor 131 for driving the drum 120 to be rotated by the rotation of the driving motor 131, but the disclosure is not limited thereto. According to another embodiment of the disclosure, a separate motor may further be provided in the housing 110 to drive the blower fan 141. According to various embodiments of the disclosure, by the air flow generated by the rotation of the blower fan 141, the air from the inside of the drum 120 may be discharged to the outside through the exhaust port 124, pass through the air circulation flow path 140, and be introduced back into the inside of the drum 120 through the hot air inlet 125.

According to various embodiments of the disclosure, a filter 146 may be disposed on the front duct 144 of the air circulation flow path 140. According to an embodiment of the disclosure, the filter 146 may filter foreign bodies in the air discharged through the exhaust port 124 from the inside of the drum 120, e.g., dust or lint from the drying item inside the drum 120. According to various embodiments of the disclosure, at least a portion of the heat pump system 150 described below and a heater 147 may be disposed on the rear duct 145 of the air circulation flow path 140.

According to an embodiment of the disclosure, the heat pump system 150 may dehumidify and heat the air circulating through the air circulation flow path 140, particularly the rear duct 145, into a hot dry state. According to various embodiments of the disclosure, the heat pump system 150 may include a compressor (250 of FIG. 3), a condenser 152, an expansion valve, and an evaporator 154. According to various embodiments of the disclosure, the compressor 250 may compress a gaseous refrigerant into a high-temperature and high-pressure state and discharge the compressed high-temperature and high-pressure refrigerant. According to various embodiments of the disclosure, the refrigerant discharged from the compressor 250 may be transferred to the condenser 152. According to various embodiments of the disclosure, the condenser 152 may dissipate heat to the surroundings while condensing the compressed gaseous refrigerant into a liquid. The liquid refrigerant condensed in the condenser 152 may be transferred to the expansion valve. According to various embodiments of the disclosure, the expansion valve may expand the high-temperature and high-pressure liquid refrigerant condensed in the condenser 152 into a low-pressure liquid refrigerant. According to various embodiments of the disclosure, the evaporator 154 may evaporate the liquid refrigerant expanded through the expansion valve, and the resultant low-temperature and low-pressure gas refrigerant may be returned to the compressor 250. According to various embodiments of the disclosure, the evaporator 154 may absorb heat from the surroundings during an evaporation process of changing the low-pressure liquid refrigerant into a gaseous refrigerant as described above. In other words, in the heat pump system 150, the refrigerant may circulate in the order of the compressor 250, the condenser 152, the expansion valve and the evaporator 154 according to the above-described flow. Although not shown in this figure, the heat pump system 150 may include a refrigerant circulation path connected between the compressor 250, the condenser 152, the expansion valve, and the evaporator 154.

According to various embodiments of the disclosure, as described above, humid air may be discharged from the drum 120 (e.g., through the exhaust port 124). According to various embodiments of the disclosure, some of the components of the heat pump system 150, e.g., the evaporator 154 and the condenser 152, may be received on the air circulation flow path 140. According to various embodiments of the disclosure, the humid air discharged from the inside of the drum 120 and introduced into the front duct 144 may be cooled through contact with the evaporator 154 on the air circulation flow path 140 and, during the cooling process, moisture may be removed from the air, forming condensate around the evaporator 154. According to various embodiments of the disclosure, the air cooled through contact with the evaporator 154 may be heated again through contact with the condenser 152 on the air circulation flow path 140 into a high-temperature and dry state. According to various embodiments of the disclosure, the air heated through the condenser 152 may be moved to the drum 120 and be further heated by the heater 147. According to various embodiments of the disclosure, as described above, the air that is dehumidified and heated into a high-temperature dry state through the evaporator 154 and the condenser 152 of the heat pump system 150 and the heater 147 may be introduced back into the drum 120 (through the hot air inlet 125 in FIG. 2), drying the drying item inside the drum 120.

According to various embodiments of the disclosure, as shown in FIG. 2, the heater 147 may be disposed downstream of the above-described heat pump system 150, particularly the evaporator 154 and the condenser 152, on the rear duct 145. According to various embodiments of the disclosure, the heater 147 may further heat the air heated by the condenser 152. According to various embodiments of the disclosure, it is possible to more quickly increase the temperature of the air supplied to the drum 120 by assisting the condenser 152 in further heating the air by the heater 147. According to an embodiment of the disclosure, the heater 147 may be a coil heater, but the disclosure is not limited thereto. According to another embodiment of the disclosure, the heater 147 may include a gas burning heating device, but the disclosure is not limited to a particular type of heater.

Figure 3:
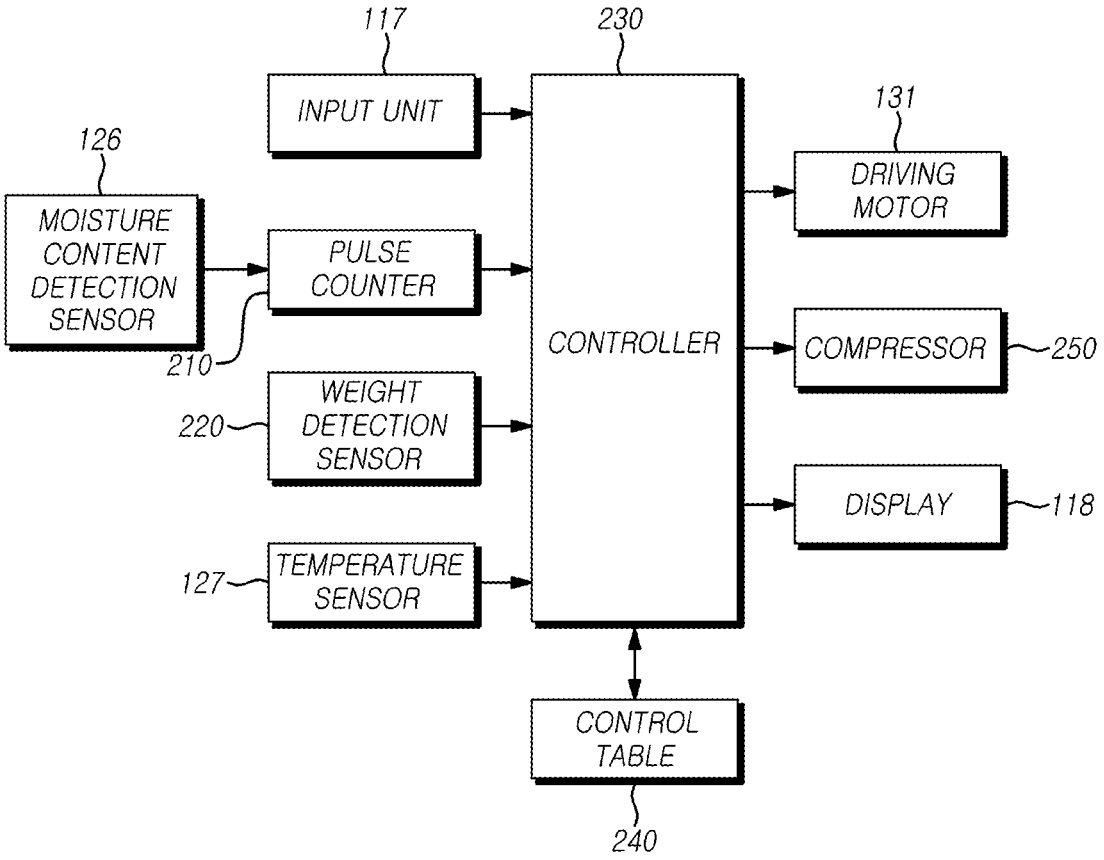
FIG. 3 is a functional block diagram schematically illustrating operation functions of the condenser clothes dryer 100 of FIG. 1 according to an embodiment of the disclosure.

FIG. 3 is a functional block diagram schematically illustrating operation functions of the condenser clothes dryer 100 of FIG. 1 according to an embodiment of the disclosure. For convenience of description, the description taken in conjunction with the drawings may focus primarily on components necessary to understand operational functions according to an embodiment of the disclosure, with the other functions omitted.

According to an embodiment of the disclosure, as shown in FIG. 3, a condenser clothes dryer 100 may include an input unit 117 obtaining various inputs and/or control commands from a user, a moisture content detection sensor 126 detecting a residual moisture content in a drying item received inside a drum 120, a pulse counter 210 comparing an electric pulse signal output from the moisture content detection sensor 126 with a predetermined reference value to count the number of pulse signals exceeding the reference value, a weight detection sensor 220 detecting the weight of the drying item received inside the drum 120, a temperature sensor 127 measuring the temperature of air introduced into the inside of the drum 120 through a hot air inlet 125, a driving motor 131 driving rotation of the drum 120 and a blower fan 141, a controller 230 controlling an overall operation of each component of the condenser clothes dryer 100, a control table 240 storing various pieces of information necessary to control the condenser clothes dryer 100, and a display 118 displaying various operation states of a compressor 250 of the heat pump system 150 and the condenser clothes dryer 100.

According to an embodiment of the disclosure, the input unit 117 may receive various inputs and/or control commands from the user. According to an embodiment of the disclosure, the input unit 117 may receive a selection for the drying mode from the user. According to an embodiment of the disclosure, the input unit 117 may receive a selection for the optimized drying mode or the manual drying mode from the user. According to various embodiments of the disclosure, the optimized drying mode may be a mode in which when the user selects the mode through the input unit 117, at the initial stage of the drying cycle, a drying level optimized for the drying item is automatically determined based on a change (reduction) in the residual moisture content of the drying item on the condenser clothes dryer 100, and a drying cycle according to a control condition (e.g., drying temperature) matching it is provided. According to various embodiments of the disclosure, the manual drying mode may be a mode in which when the user selects the mode through the input unit 117, a drying cycle is provided according to a predetermined control condition (e.g., drying temperature) according to the user's selection. According to an embodiment of the disclosure, the input unit 117 may obtain a selection regarding the desired drying degree from the user. According to an embodiment of the disclosure, the input unit 117 receives, from the user, a selection of one of a plurality of predetermined desired drying degrees, e.g., four levels of delicate drying, mild drying, standard drying, and intensive drying (however, the disclosure is not limited thereto). For example, the above-described four levels, i.e., delicate drying, mild drying, standard drying, and intensive drying, may represent drying degrees in increasing intensity in the order thereof. According to an embodiment of the disclosure, the input unit 117 may receive a start and/or stop command of the drying cycle from the user.

According to an embodiment of the disclosure, the moisture content detection sensor 126 may contact the drying item inside the drum 120 to output an electric pulse signal (e.g., voltage or current pulse signal) according to the moisture content of the drying item as described above in connection with FIG. 1. According to an embodiment of the disclosure, as described above in connection with FIG. 1, the moisture content detection sensor 126 may include two touch electrode sensors spaced apart from each other at a predetermined interval and, when the drying item in a wet state contacts both the two touch electrode sensors, output a predetermined electrical signal as the two touch electrodes are shorted through the drying item. According to an embodiment of the disclosure, if the amount of the residual moisture in the drying item contacting the moisture content detection sensor 126 increases, current may flow more smoothly, so that an electrical pulse signal having a higher voltage or current value may be output while the residual moisture in the drying item reduces, current flow is not smooth so that an electrical pulse signal with a low voltage and current value may be output.

According to an embodiment of the disclosure, the pulse counter 210 may continuously receive the electric pulse signal output from the moisture content detection sensor 126. According to an embodiment of the disclosure, the pulse counter 210 may compare the electrical pulse signal received from the moisture content detection sensor 126 with a predetermined reference value and count the number of electrical pulse signals (number of occurrences) above the corresponding reference value. According to an embodiment of the disclosure, while the drying cycle is in progress, the pulse counter 210 may count the number of electric pulse signals above the above-described predetermined reference value per unit time (e.g., 1 minute).

According to an embodiment of the disclosure, the weight detection sensor 220 may detect the weight of the drying item received in the drum 120 at the initial stage of operation of the condenser clothes dryer 100. According to an embodiment of the disclosure, the weight detection sensor 220 may detect the weight of the drying item based on the current value supplied to the driving motor 131 when the driving of the driving motor 131 starts, for example. In general, the current value supplied to the driving motor generally increases in proportion to the total weight. However, since the current value is not precisely differentiated as the weight increases, according to an embodiment of the disclosure, the weight of the drying item detected by the weight detection sensor 220 may be information indicating a weight range according to a predetermined standard, rather than an exact weight value. According to various embodiments of the disclosure, the weight of the drying item detected by the weight detection sensor 220, along with the initial residual moisture content information obtained through the above-described moisture content detection sensor 126 and the pulse counter 210, may be used for initial category classification for the drying item as described below.

According to various embodiments of the disclosure, the temperature sensor 127 may detect the temperature of the air supplied into the drum 120. According to an embodiment of the disclosure, the temperature sensor 127 may be disposed in a rear lower position of the drum 120 as described above in connection with FIG. 2, but the disclosure is not limited thereto. According to another embodiment of the disclosure, the temperature sensor may be disposed in a predetermined position on the rear duct 145, such as near the hot air inlet 125 or downstream of the heater 146. In this figure and description, it is only mentioned that the condenser clothes dryer 100 includes a temperature sensor 127 for measuring the temperature of the air inside the drum 120, but according to other embodiments of the disclosure, the condenser clothes dryer 100 may include a temperature sensor disposed in a predetermined position near the exhaust port 124 and configured to measure the temperature of humid air discharged from the inside of the drum 120 as described above. According to various embodiments of the disclosure, the temperature sensor 127 may continuously monitor the temperature of the air introduced into the drum 120 while the drying cycle continues. According to various embodiments of the disclosure, the temperature of the air detected by the temperature sensor 127 may be used to control the on/off of the compressor 250 to maintain the air temperature inside the drum 120 as described below.

According to an embodiment of the disclosure, the driving motor 131 may rotate clockwise and/or counterclockwise according to the control signal from the controller 230 to be described below. According to an embodiment of the disclosure, as described above in connection with FIG. 1, the rotation of the driving motor 131 may rotate the drum 120 through the driving pulley 132 and the belt 133 of the drum driver 130. According to an embodiment of the disclosure, the driving motor 131 may also be connected to the blower fan 141 to rotate the blower fan 141, but the disclosure is not limited thereto. According to various embodiments of the disclosure, the rotation of the drum 120 and the blower fan 141 caused by the rotation of the driving motor 131 may enable drying processing for the drying item inside the drum 120.

According to various embodiments of the disclosure, the compressor 250 may operate according to a predetermined operating frequency under the control of the controller 230 to be described below. According to various embodiments of the disclosure, the compressor 250 may compress the gaseous refrigerant into a high-temperature and high-pressure state and then discharge it. According to various embodiments of the disclosure, as the operating frequency of the compressor 250 increases, the temperature of the refrigerant discharged from the compressor 250 may increase. According to an embodiment of the disclosure, the controller 230 may adjust the operating frequency of the compressor 250 based on a control condition determined according to the optimized drying level determined for the drying item and control the on/off of the compressor 250 considering the measurement value of the temperature sensor 127 as described below.

According to an embodiment of the disclosure, the controller 230 may receive, from the above-described input unit 117, various inputs and/or control commands from the user, received on the input unit 117. According to an embodiment of the disclosure, the controller 230 may receive a selection of the optimized drying mode by the user from the input unit 117. According to various embodiments of the disclosure, in the case of receiving the selection of the optimized drying mode, the controller 230 may first obtain the weight information about the drying item received from the weight detection sensor 220. According to various embodiments of the disclosure, the controller 230 may control the operation of each component of the condenser clothes dryer 100 to perform the initial drying cycle for determining the optimized drying level. According to various embodiments of the disclosure, while performing the initial drying cycle, the controller 230 may obtain number-of-pulses information (i.e., information indicating the residual moisture content state of the drying item) received from the pulse counter 210 and determine the initial category for the corresponding drying item based on the above-described number-of-pulses information and the weight information about the drying item obtained from the weight detection sensor 220. According to various embodiments of the disclosure, the controller 230 may continue to monitor the number-of-pulses information (i.e., information indicating the residual moisture content state of the drying item) received from the pulse counter 210 while performing the initial drying cycle and determine the optimized drying level for the drying item based on the monitoring result. According to various embodiments of the disclosure, the controller 230 may control the operation of each component of the condenser clothes dryer 100 so that the optimized drying level for the drying item is determined during the initial drying cycle and then a drying cycle is performed according to the control condition matching the determined drying level.

According to an embodiment of the disclosure, the controller 230 may receive selection information about the desired drying degree by the user, e.g., information about the desired drying degree selected by the user from among the delicate drying, mild drying, standard drying, and intensive drying. According to an embodiment of the disclosure, the controller 230 may control the operation of each component of the condenser clothes dryer 100 so that drying under the control condition matching the selection information about the received desired drying degree is performed based thereupon. According to an embodiment of the disclosure, the controller 230 may receive a start and/or stop command of the drying cycle from the user through the input unit 117 and, to allow the drying cycle to start or stop accordingly, control the operation of each component of the condenser clothes dryer 100.

According to an embodiment of the disclosure, the control table 240 may store various pieces of information necessary to control the operation of the condenser clothes dryer 100. According to an embodiment of the disclosure, as described above, the control table 240 may store various pieces of control information, including control information (e.g., operation control information about the compressor 250 and/or heater 147 while the initial drying cycle proceeds to determine the optimized drying level, and various time information, threshold information, and numerical value information to be used for the initial drying cycle) to be used while the initial drying cycle is performed after a dry start command is input from the user and control information (e.g., operation control information about the compressor 250 and/or heater 147 per drying level during the drying cycle after determining the drying level and total drying time determination information per drying level) to be used while the drying cycle is performed after the optimized drying level is determined. According to an embodiment of the disclosure, upon receiving a dry start command and a selection of the optimized drying mode through the input unit 117, the controller 230 may initiate the initial drying cycle as described above. According to an embodiment of the disclosure, the controller 230 may obtain various pieces of information to be used while the initial drying cycle is performed, from, e.g., the control table 240. According to an embodiment of the disclosure, the controller 230 may control the operation of the driving motor 131, compressor 250, and/or heater 147 based on various pieces of information obtained from the control table 240, for performing the procedure of the initial drying cycle for selecting the optimized drying level for the drying item. According to an embodiment of the disclosure, the controller 230 may select the optimized drying level for the drying item based on various pieces of information obtained from the control table 240.

According to an embodiment of the disclosure, the display 118 may display information regarding the operation state of the condenser clothes dryer 100. According to an embodiment of the disclosure, while the condenser clothes dryer 100 performs the initial drying cycle to determine the optimized drying level for the drying item under the control of the controller 230, the display 118 may display the progress state of the initial drying cycle, e.g., information for the fact that the initial drying cycle proceeds, initial category information determined when the initial category is determined, and expected remaining time information about the initial drying cycle, but the disclosure is not limited thereto. According to an embodiment of the disclosure, while the optimized drying level for the drying item is selected, and the drying cycle is accordingly performed under the control of the controller 230, the display 118 may display the progress state of the drying cycle, e.g., the corresponding drying level, the elapsed drying time, and the expected remaining time information about the drying cycle, but the disclosure is not limited thereto.

FIG. 4 is a flowchart schematically illustrating an overall process for drying a drying item according to an optimized drying mode by a condenser clothes dryer 100 under the control of the controller 230 of FIG. 3 according to an embodiment of the disclosure.

First, in step 402, the controller 230 may determine whether a selection of a desired drying degree (e.g., one user desired drying degree selected from among four levels, e.g., delicate drying, mild drying, standard drying, and intensive drying) and a dry start command are obtained from the input unit 117. Upon determining that the selection of the desired drying degree and the dry start command are received in step 402, the process may proceed to step 404.

In step 404, in a state in which the compressor 250 and the heater 147 are turned off, the controller 230 may turn on the driving motor 131 to initiate rotation of the drum 120 and detect the weight of the drying item received in the drum 120. According to an embodiment of the disclosure, the controller 230 may obtain, e.g., weight information about the drying item detected by the weight detection sensor 220. According to an embodiment of the disclosure, the controller 230 may detect the motor current value consumed by the driving motor 131 and obtain the weight information about the drying item based thereupon, but the disclosure is not limited to a specific type.

In step 406, the controller 230 may retrieve and obtain various pieces of initial control information to be used during the initial drying cycle for determining the optimized drying level per characteristic of the drying item from the control table 240. According to an embodiment of the disclosure, the initial control information retrieved and obtained from the control table 240 may include, e.g., upper/lower temperature limit information for on/off control of the compressor 250 and the operating frequency for the compressor 250 of the heat pump system 150, upper/lower temperature limit information for on/off control of the heater 147, driving time duration information for the driving motor 131, various pieces of time information, threshold information, and/or numerical information.

Then, in step 408, the controller 230 may control the operation of the compressor 250 and/or the driving motor 131 based on the initial control information obtained in step 406 and initiate the initial drying cycle for classifying (and determining the optimized drying level) per characteristic of the drying item. According to various embodiments of the disclosure, while the initial drying cycle is performed, the controller 230 may control the on/off of the driving motor 131 according to the initial control information, particularly the initial driving time information for the driving motor 131. According to various embodiments of the disclosure, during the initial drying cycle, the controller 230 may control the operation of the compressor 250 according to the operating frequency information for the compressor 250. According to various embodiments of the disclosure, the controller 230 may continuously receive the temperature information detected from the temperature sensor 127 during the initial drying cycle and compare the temperature information received from the temperature sensor 127 with the upper/lower temperature limit information for on/off control of the compressor 250 and/or upper/lower temperature limit information for on/off control of the heater 147 to control the on/off the compressor 250 and/or the on/off of the heater 147. According to various embodiments of the disclosure, when the temperature detected from the temperature sensor 127 reaches the upper temperature limit, the controller 230 may turn off the compressor 250 and/or the heater 147. According to various embodiments of the disclosure, when the temperature detected from the temperature sensor 127 reaches the lower temperature limit, the controller 230 may turn on the compressor 250 and/or the heater 147. According to various embodiments of the disclosure, during the initial drying cycle, the controller 230 may continuously obtain the number of pulses from the moisture content detection sensor 126 above a predetermined threshold, counted per unit time (e.g., 1 minute) from the pulse counter 210. According to an embodiment of the disclosure, during the initial drying cycle, the controller 230 may calculate the average of the numbers of pulses obtained from the pulse counter 210 per unit time, over a predetermined time window (e.g., 7 minutes) and use the calculated average as moisture content information during the process of determining the drying level for the drying item as described below.

In step 410, the controller 230 may obtain the residual moisture content information (initial moisture content information), when a predetermined time (e.g., 8 minutes, but the disclosure is not limited thereto) after the initial drying cycle is initiated lapses. As described above, according to an embodiment of the disclosure, the controller 230 may obtain the average over the predetermined time window (e.g., 7 minutes) of the numbers of pulses obtained from the pulse counter 210, as the residual moisture content information about the drying item. The initial moisture content information obtained in step 410 may be the average of the numbers of pulses for the predetermined time window (e.g., 7 minutes) retroactively from the time of determination (e.g., eight minutes after the initial drying cycle is initiated).

Subsequently, in step 412, the controller 230 may compare the weight information about the drying item obtained in step 408 and the initial moisture content information about the drying item obtained in step 410 with the information obtained from the control table 240, classifying the initial category of the drying item. In this regard, FIG. 5 illustrates an example table 500 including a plurality of predefined initial categories and threshold information defining each initial category according to an embodiment of the disclosure. According to an embodiment of the disclosure, as shown in FIG. 5, a plurality of weight classifications may be defined for each weight range of the drying item, and a plurality of moisture content classifications may be defined per initial moisture content range of the drying item. According to an embodiment of the disclosure, as shown in FIG. 5, a plurality of initial categories may be defined by combinations of the weight classifications of the drying item and initial moisture content classifications. In step 412, primary classifications may be performed according to the load characteristics of the drying item by classifying the initial category based on the weight of the drying item and the initial moisture content information.

Specifically, referring to FIG. 5, two weight classifications of column 502 and column 504 are defined respectively for when the weight information about the drying item is equal to or more than the reference value, e.g., 500, or for when the weight information about the drying item is less than the reference value, e.g., 500, but the disclosure is not limited thereto. According to another embodiment of the disclosure, more weight classifications may be defined according to other various criteria. Referring to FIG. 5, four moisture content classifications, e.g., when the moisture content is 1000 or more and 1200 or less, when the moisture content is 800 or more and less than 1000, when the moisture content is 200 or more and less than 800, and when the moisture content is less than 200, are defined in the rows 512 to 518, respectively, according to the initial moisture content information (e.g., the average over a predetermined time of the numbers of pulses obtained from the pulse counter 210) for the drying item, but the disclosure is not limited thereto. According to another embodiment of the disclosure, more or fewer moisture content classifications may be defined according to other various reference values. As shown in FIG. 5, a total of eight initial categories are defined by combinations of the two weight classifications and four moisture content classifications, but the disclosure is not limited thereto. As shown in FIG. 5, e.g., initial category 1 may be the case where the weight and initial moisture content of the drying item both are high, initial category 8 may be the case where the weight and initial moisture content both are low, and initial category 4 may be the case where the weight is high but the initial moisture content is low. According to various embodiments of the disclosure, as described below, reference times and moisture content thresholds may be individually defined as used to determine the optimized drying level for the drying item, for each initial category. According to various embodiments of the disclosure or as described below, for each initial category, a plurality of drying levels, e.g., high-load drying level, low-load drying level, and/or special load drying level, which may be selected according to the state of the reduction in residual moisture content over time, may be defined.

Referring back to FIG. 4, in step 414, the controller 230 allows the initial drying cycle to go on and continuously monitors the residual moisture content information that reduces over time, e.g., the average over a predetermined time (e.g., 7 minutes) of the numbers of pulses above the threshold obtained from the pulse counter 210 per unit time while determining the drying level for the drying item from the result of monitoring the residual moisture content (residual moisture content reduction state) and the result of initial category classification in step 412. According to various embodiments of the disclosure, as described above, each reference time and moisture content threshold information to be used to determine the optimized drying level may be previously defined per initial category of the drying item. In Step 414, the reference time and moisture content threshold information defined for each initial category are compared with the residual moisture content information (i.e., average of numbers of pulses) continuously monitored, thereby determining the optimized drying level for the drying item. According to this process, a primary classification according to the load characteristics of the drying item is performed by determining the initial category, and then a further classification more closely matching the load characteristics of the drying item is performed with reference to the moisture content reduction state (i.e., drying progress state) of the drying item that occurs during a subsequent drying cycle based on the primary classification. In this regard, FIG. 6 more specifically illustrates the process of determining the optimized drying level for the drying item of step 414.

Figure 6:
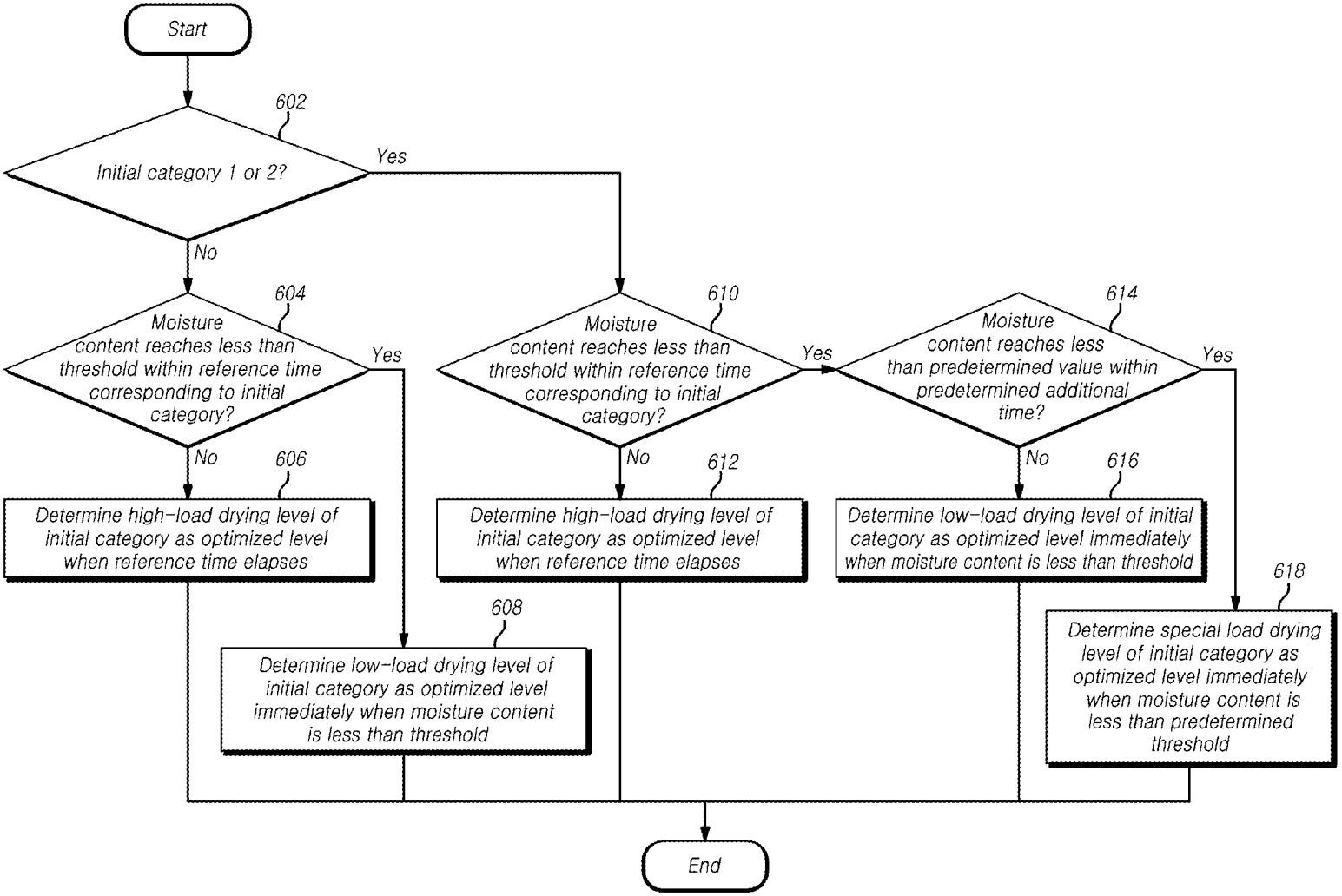
FIG. 6 is a flowchart illustrating, in detail, a process of determining an optimized drying level for a drying item in step 414 of FIG. 4.

Referring to FIG. 6, in step 602, the controller 230 may determine whether the initial category determined in step 412 corresponds to a predetermined category (e.g., category 1 or 2) in which both the weight and residual moisture content are high. In step 602, upon determining that the initial category does not correspond to the predetermined category (e.g., category 1 or 2), the process may proceed to step 604, and the controller 230 may continuously determine whether the residual moisture content information within the reference time defined corresponding to the initial category of the drying item (i.e., the average over the predetermined time of the numbers of pulses obtained from the pulse counter 210) reaches less than a given moisture content threshold. According to an embodiment of the disclosure, each reference time defined for each initial category may be determined to be a value that gradually increases as the initial moisture content information, which is the reference of the initial category classification, reduces (e.g., in case of FIG. 5, the reference time determined for category 4 may be longer than the reference time determined for category 1, and the reference time determined for category 8 may be longer than the reference time determined for category 5), but the disclosure is not limited thereto. According to an embodiment of the disclosure, each moisture content threshold defined for each initial category may be determined to be a value that gradually decreases as the initial moisture content information, which is the reference of the initial category classification, reduces (e.g., in FIG. 5, the moisture content threshold determined for category 1 may be larger than the moisture content threshold determined for category 4, and the moisture content threshold determined for category 5 may be larger than the moisture content threshold determined for category 8), but the disclosure is not limited thereto. According to an embodiment of the disclosure, the moisture content thresholds defined per initial category may be determined to be the same value when the weight information, which is the classification reference of the initial category, has the same range (e.g., in FIG. 5, the moisture content threshold determined for category 1 may be identical to the moisture content threshold determined for category 5, and the moisture content threshold determined for category 2 may be identical to the moisture content threshold determined for category 6), but the disclosure is not limited thereto.

Upon determining in step 604 that the residual moisture content information obtained until the given reference time expires fails to reach less than the threshold, the process may proceed to step 606 and, from the time when the reference time elapses, the drying level defined as a high-load drying level for the given initial category may be determined to be the optimized drying level for the drying item. In this regard, FIG. 7 illustrates an example of a high-load drying level, a low-load drying level, and/or a special load drying level, defined per initial category according to an embodiment of the disclosure.

Referring to FIG. 7, according to an embodiment of the disclosure, a total of eight initial categories may be defined as shown in FIG. 5, and drying levels, as the high-load drying level and the low-load drying level, are defined per initial category. According to an embodiment of the disclosure, as shown in FIG. 7, the low-load drying level defined per initial category is defined as one-step lower than the high-load drying level and, for initial categories 4 and 8 (the categories in which the residual moisture content was relatively low when determining the initial category), the high-load drying level and the low-load drying level may be defined as the same value, but the disclosure is not limited thereto. According to an embodiment of the disclosure, as shown in FIG. 7, for categories 1 and 2 (the categories in which both the weight and residual moisture content were relatively high when determining the initial category), a special load drying level may further be defined in addition to the high-load drying level and the low-load drying level, unlike the other initial categories, but the disclosure is not limited thereto. As shown in FIG. 7, the special load drying level is defined as on-step lower than the low-load drying level defined for the corresponding initial category, but the disclosure is not limited thereto. The initial categories shown in FIG. 7 and the drying levels respectively defined for them are merely an example for a better understanding of the disclosure, but the disclosure is not limited thereto.

FIG. 7 illustrates a total of five levels from level 5 to level 1, and these levels each may represent the control condition to be used for the drying cycle. According to various embodiments of the disclosure, the operating frequency of the compressor 250 corresponding to any level (e.g., a higher level with a larger level number) may be determined to be above the operating frequency of the compressor 250 corresponding to a one-step lower level (e.g., a lower level with a smaller level number) than the level. According to various embodiments of the disclosure, each temperature (upper/lower temperature limit) for on/off control of the compressor 250 corresponding to any level (e.g., a higher level with a larger level number) may be determined to be above each temperature (upper/lower temperature limit) for on/off control of the compressor 250 corresponding to a one-step lower level (e.g., a lower level with a smaller level number) than the level. According to an embodiment of the disclosure, the control condition for the initial drying cycle used for the initial drying cycle, e.g., the temperature for on/off control of the compressor 250 and the operating frequency of the compressor 250, may be values, which are lower than values defined for the highest level (e.g., level 5) and higher than values defined for the lowest level (e.g., level 1), but the disclosure is not limited thereto. According to an embodiment of the disclosure, the control condition for the initial drying cycle used for the initial drying cycle, e.g., the temperature for on/off control of the compressor 250 and the operating frequency of the compressor 250, may be the same value as the values corresponding to an intermediate level (e.g., level 3), but the disclosure is not limited thereto.

Referring back to FIG. 6, upon determining in step 604 that the residual moisture content information obtained at an arbitrary time before expiration of the reference time reaches less than the moisture content threshold, the process may proceed to step 608, and the controller 230 may determine that the drying level defined as the low-load drying level for the given initial category is the drying level for the drying item from the time when the residual moisture content information is determined to be less than the moisture content threshold in step 604 (e.g., referring to FIG. 7, when the initial category is category 3, level 2 may be determined to be the drying level of the drying item).

In step 602, upon determining that the initial category corresponds to a predetermined category (e.g., category 1 or 2), the process may proceed to step 610. In step 610, similar to step 604, the controller 230 may determine whether the residual moisture content information (i.e., the average over the predetermined time of the numbers of pulses obtained from the pulse counter 210) reaches less than the given moisture content threshold within the reference time defined corresponding to the initial category of the drying item.

In step 610, upon determining that the residual moisture content information obtained through the expiration of the given reference time fails to reach less than the threshold, the process may proceed to step 612 and, similar to step 606, the drying level defined as the high-load drying level regarding the given initial category may be determined to be the optimized drying level for the drying item from the time when the reference time elapses (e.g., referring to FIG. 7, when the initial category is category 1, level 5 may be determined to be the drying level of the drying item).

In step 610, upon determining that the residual moisture content information obtained at an arbitrary time before the expiration of the given reference time reaches less than the threshold, the process may proceed to step 614, and the controller 230 may continuously determine whether the residual moisture content information obtained within a predetermined additional time (i.e., within a time when an additional time predetermined per initial category elapses from the start when the residual moisture content information is less than the moisture content threshold in step 610) (i.e., the average over the predetermined, e.g., 7 minutes, of the numbers of pulses obtained from the pulse counter 210) reaches less than a predetermined value (e.g., 200). In step 614, upon determining that the residual moisture content information obtained though the expiration of the given additional time fails to reach less than the predetermined value, the process may proceed to step 616, and the drying level defined as the low-load drying level regarding the given initial category may be determined to be the drying level for the drying item from the time when the additional time elapses (e.g., referring to FIG. 7, when the initial category is category 1, level 4 may be determined to be the drying level of the drying item).

In step 614, upon determining that the residual moisture content information obtained at an arbitrary time before expiration of the given reference time reaches less than the predetermined value (e.g., 200), the process may proceed to step 618, and the drying level defined as the special load drying level regarding the given initial category may be determined to be the drying level for the drying item from the time when the residual moisture content information is determined to be less than the predetermined value (e.g., referring to FIG. 7, when the initial category is category 1, level 3 may be determined to be the drying level of the drying item).

According to an embodiment of the disclosure, the additional time that is the reference for determination in step 614 may be a value determined per initial category (e.g., for category 1 in which the weight and moisture content are higher at the time of determining the initial category, a longer value may be determined than category 2 that is lower than category 1), but the disclosure is not limited thereto. According to another embodiment of the disclosure, the above-described reference time may be a value determined as the same value regardless of the initial category of the drying item. According to an embodiment of the disclosure, in relation to step 614, the predetermined value compared with the residual moisture content information until the additional time expires may be a fixed constant value (e.g., 200 as described above) determined regardless of the initial category, but the disclosure is not limited thereto. According to another embodiment of the disclosure, the above-described predetermined value may be a value determined per initial category of the drying item.

Referring back to FIG. 4, the controller 230 may proceed to step 416 immediately when the drying level is determined in step 414 and apply the control condition (e.g., the operating frequency of the compressor and the upper/lower temperature limit for on/off control of the compressor) defined according to the determined drying level and perform the subsequent main drying cycle. According to an embodiment of the disclosure, after starting the main drying cycle to which the control condition according to the determined drying level has been applied in step 416, in step 418, the controller 230 may determine whether it is needed to recheck whether to change the drying level to provide a further optimized drying cycle. According to various embodiments of the disclosure, e.g., in step 418, the controller 230 may determine whether the drying level currently determined for the drying item is one of a predetermined number of higher drying levels (e.g., one or more drying levels having a higher operating frequency and higher upper/lower temperature limit for the compressor, e.g., level 4 or level 5 of FIG. 7) and, if so, determine that it is needed to recheck whether to change the drying level.

If it is determined in step 418 that it is not needed to recheck whether to change the drying level (e.g., when the current drying level is determined not to correspond to the predetermined number of higher drying levels, e.g., level 4 or level 5 of FIG. 7), the controller 230 may continue the main drying cycle according to the control condition applied in step 416. When it is determined in step 418 that it is needed to recheck whether to change the drying level (e.g., when the current drying level is determined to correspond to the predetermined number of higher drying levels, e.g., level 4 or level 5 of FIG. 7), the process may proceed to step 420. In step 420, the controller 230 may determine whether to change the drying level and, as necessary accordingly, appropriately change the drying level and apply a change in control condition according thereto. In this regard, FIG. 8 more specifically illustrates a process regarding changing the drying level and the control condition in step 420.

Figure 8:
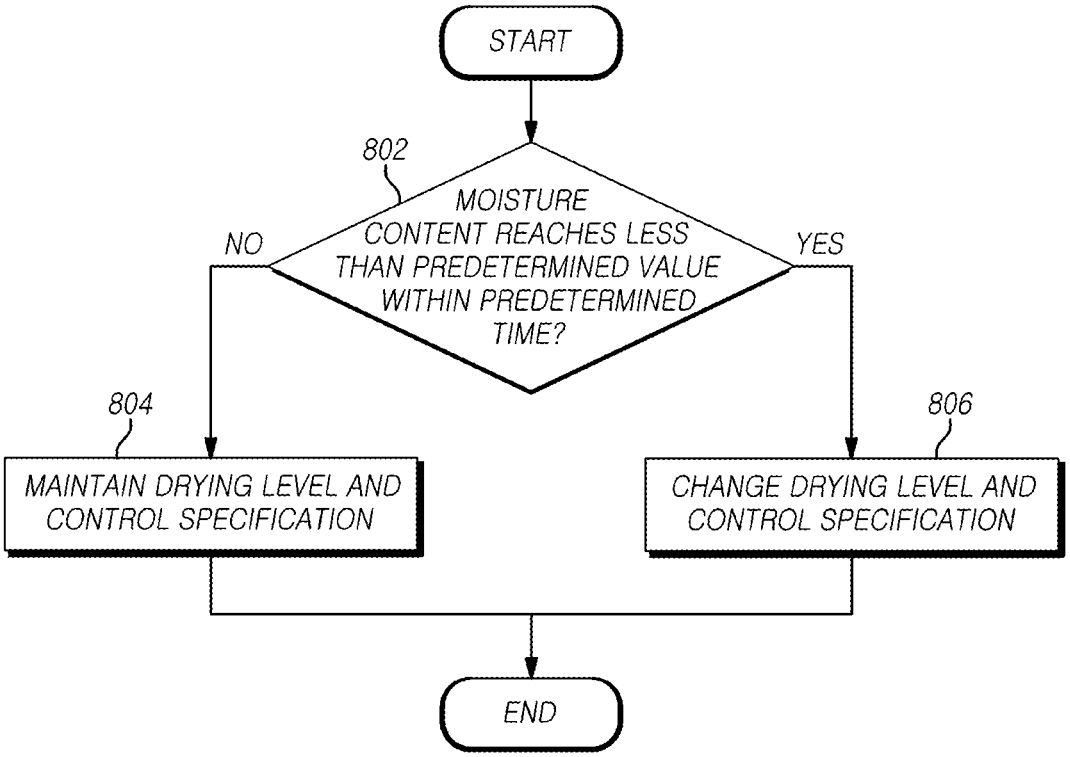
FIG. 8 is a flowchart illustrating, in detail, a process of changing the drying level and control condition for a drying item in step 420 of FIG. 4.

Referring to FIG. 8, in step 802, the controller 230 may determine again whether the residual moisture content information reaches less than a predetermined value within a predetermined time from the time when a drying level is determined in step 416 and the control condition change according thereto is applied. According to an embodiment of the disclosure, the predetermined time that is the reference for determination in step 802 may be a time respectively determined for the current drying level (merely as an example, it may be 30 minutes for level 5 of FIG. 7 and 20 minutes for level 4), but the disclosure is not limited thereto. According to an embodiment of the disclosure, the above-described predetermined time may be a value determined as the same value regardless of the drying level. According to an embodiment of the disclosure, the predetermined value that is the reference for determination in step 802 may be a fixed constant value (e.g., 500 as described above) determined regardless of the drying level, but the disclosure is not limited thereto. According to another embodiment of the disclosure, the above-described predetermined value may be a value determined for each drying level.

In step 802, upon determining that the residual moisture content information fails to reach less than a predetermined value within a predetermined time, the process may proceed to step 804, and the current drying level (e.g., level 4 or level 5 of FIG. 7) and control condition may be maintained. In step 802, upon determining that the residual moisture content information reaches less than the predetermined value within the predetermined time, the process may proceed to step 806 so that the current drying level may be changed as determined, and the control condition may be changed and applied to match the changed drying level. According to various embodiments of the disclosure, upon determining that the residual moisture content information reaches less than the predetermined value within the predetermined time in step 802, in step 806, the controller 230 may change the drying level for the drying item into a drying level (merely as an example, level 3 or 2) lower than the current drying level (e.g., a predetermined number of higher drying levels, e.g., level 4 or level 5 of FIG. 7) and apply the control condition matching the changed drying level (e.g., the operating frequency of the compressor corresponding to the changed drying level and the upper/lower temperature limit for on/off control of the compressor) to the subsequent drying cycles.

Referring back to FIG. 4, the controller 230 may determine whether a preliminary termination condition is met while the main drying cycle lasts in step 422. The preliminary termination condition of the main drying cycle does not mean a condition for completely terminating the main drying cycle, but may mean that when such condition is met, an appropriate additional drying time is determined considering, e.g., the desired drying degree selected by the user and the drying level determined for the drying item, and after the main drying cycle is further performed for the determined additional drying time, the drying cycle is terminated. According to various embodiments of the disclosure, the preliminary termination condition of the main drying cycle may be predetermined for each user selected desired drying degree (e.g., a user selected desired drying degree selected from among the four levels, i.e., delicate drying, mild drying, standard drying, and intensive drying) obtained in step 402. As described above, the number of pulses obtained from the pulse counter 210 may indicate the residual moisture content, i.e., drying degree, of the drying item inside the drum 120 (the smaller the number of pulses, the lower the residual moisture content of the drying item may be). According to an embodiment of the disclosure, the preliminary termination condition of the main drying cycle may be defined as when less than a respectively predetermined number of pulses for each desired drying degree is obtained over three consecutive times (this is merely an example, but the disclosure is not limited thereto) from the pulse counter 210, but the disclosure is not limited thereto. According to an embodiment of the disclosure, the preliminary termination condition of the main drying cycle may be defined, e.g., as when less than "a" (which is merely an example) pulses are obtained three consecutive times (which is merely an example) from the pulse counter 210 if the selected desired drying degree is delicate drying or when "b" pulses, being less than or equal to "a" pulses (b<=a) (which is merely an example), are obtained three consecutive times if the desired drying degree is mild drying, but the disclosure is not limited thereto. According to an embodiment of the disclosure, the preliminary termination condition of the main drying cycle may be defined, e.g., as when "c" pulses, being less than or equal to "b" pulses (c<=b), are obtained three consecutive times (which is merely an example) from the pulse counter 210 if the selected desired drying degree is standard drying or "d" pulses, being less than or equal to "c" pulses (d<=c)(which are merely examples), are obtained three consecutive times from the pulse counter 210 if the selected desired drying degree is intensive drying, but the disclosure is not limited thereto. According to an embodiment of the disclosure, the preliminary termination condition of the main drying cycle defined for each desired drying degree may be stored in the control table 240, but the disclosure is not limited thereto.

If it is determined in step 422 that the preliminary termination condition of the drying cycle is met, the process may proceed to step 424, determining an additional drying time, and the existing main drying cycle may last for the determined additional drying time. According to an embodiment of the disclosure, the controller 230 may determine the additional drying time according to a predetermined criterion based on the total drying cycle progress time to the time when the preliminary termination condition of the drying cycle is determined to be met in step 422, and whether the drying level for the drying item determined in step 414 is the high-load drying level or lower-load/special load drying level defined regarding the corresponding initial category, and/or the desired drying degree selected by the user. According to an embodiment of the disclosure, the criterion for determining the additional drying time may be defined as there being no additional drying time in the case of delicate drying or mild drying in which the desired drying degree selected by the user is relatively low, but the disclosure is not limited thereto. According to an embodiment of the disclosure, the criterion for determining the additional drying time may be defined to create an additional drying time relatively longer than that in the case of the lower-load/special load drying level, when the drying level for the drying item determined in step 414 is high-load drying level defined regarding the corresponding initial category, but the disclosure is not limited thereto. According to an embodiment of the disclosure, the criterion for determining the additional drying time may be defined to create an additional drying time relatively longer than that in the case of standard drying, in intensive drying in which the desired drying degree selected by the user is higher, but the disclosure is not limited thereto. According to various embodiments of the disclosure, various methods for determining an additional drying time appropriate for each context may be considered, but the disclosure is not limited to a specific type.

In step 426, the controller 230 may determine whether the additional drying time determined in step 422 elapses and, upon determining that the additional drying time elapses, the process may proceed to step 428 so that the controller 230 may perform a cooling cycle during a predetermined time. According to an embodiment of the disclosure, when the cooling cycle is performed, the controller 230 may control the drum 120 and blower fan 141 to continue rotation, with the compressor 250 and the heater 147 both turned off, thereby decreasing the temperature of the air inside the drum 120.

In the disclosure, an example in which the initial category of the drying item is classified into a total of eight categories is described, but the disclosure is not limited thereto. According to an embodiment of the disclosure, the initial category of the drying item may be classified into more or fewer categories. In the disclosure, an example in which the drying level of the drying item is determined to be one selected from among a total of five levels, but the disclosure is not limited thereto. According to an embodiment of the disclosure, the drying level of the drying item may be determined to be one of more various levels.

In the disclosure, the description focuses primarily on the condenser clothes dryer, but the disclosure is not limited thereto. The disclosure is also applicable to vented clothes dryers.

The terms as used herein are provided merely to describe some embodiments thereof, but are not intended to limit the disclosure. As used herein, the singular forms "a," "an," and "the" are intended to include the plural forms as well, unless the context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, the term 'and/or' should be understood as encompassing any and all possible combinations by one or more of the enumerated items. As used herein, the terms "include," "have," and "comprise" are used merely to designate the presence of the feature, component, part, or a combination thereof described herein, but use of the term does not exclude the likelihood of presence or adding one or more other features, components, parts, or combinations thereof. As used herein, the terms "first" and "second" may modify various components regardless of importance and/or order and are used to distinguish a component from another without limiting the components.

As used herein, the terms "configured to" may be interchangeably used with the terms "suitable for," "having the capacity to," "designed to," "adapted to," "made to," or "capable of" depending on circumstances. The term "configured to" does not essentially mean "specifically designed in hardware to." Rather, the term "configured to" may mean that a device can perform an operation together with another device or parts. For example, a 'device configured (or set) to perform A, B, and C' may be a dedicated device to perform the corresponding operation or may mean a general-purpose device capable of various operations including the corresponding operation.

As used herein, the term "part" or "module" may include a unit implemented in hardware, software, or firmware, and may interchangeably be used with other terms, for example, "logic," "logic block," "part," or "circuitry". A part or module may be a single integral component, or a minimum unit or part thereof, adapted to perform one or more functions. For example, according to an embodiment, 'part' or 'module' may be implemented in a form of an application-specific integrated circuit (ASIC).

According to various embodiments, each component (e.g., a module or a program) of the above-described components may include a single entity or multiple entities. Some of the plurality of entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

In the disclosure, the above-described description has been made mainly of specific embodiments, but the disclosure is not limited to such specific embodiments, but should rather be appreciated as covering all various modifications, equivalents, and/or substitutes of various embodiments.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes dryer, comprising:

a drum configured to receive a drying item;

a weight detection sensor configured to detect a weight of the drying item in the drum;

a moisture content detection circuit configured to obtain residual moisture content information about the drying item in the drum; and a controller configured to:

determine a category for the drying item among a plurality of categories based on the weight of the drying item detected by the weight detection sensor and the residual moisture content information about the drying item obtained by the moisture content detection circuit at a first predetermined time after an initial drying cycle is initiated according to an initial control condition, monitor a reduction state in the residual moisture content information about the drying item obtained by the moisture content detection circuit based on a reference time and a moisture content threshold defined corresponding to the determined category to determine a drying level for the drying item, and initiate a main drying cycle according to a control condition corresponding to the determined drying level, wherein each of the plurality of categories is defined by a combination of a plurality of weight classifications defined per a weight range of the drying item and a plurality of residual moisture content classifications defined per residual moisture content information range of the drying item.

2. The clothes dryer of claim 1, wherein to determine the drying level the controller is configured to determine whether the residual moisture content information about the drying item obtained by the moisture content detection circuit before the reference time elapses reaches less than the moisture content threshold.

3. The clothes dryer of claim 1, wherein the residual moisture content information obtained by the moisture content detection circuit is average information about a signal indicating a moisture content of the drying item detected over a predetermined time retroactively from a time when the residual moisture content information is obtained.

4. The clothes dryer of claim 1, further comprising a heat pump system configured to heat air introduced into an inside of the drum and including a compressor, a condenser, an expansion valve, and an evaporator, wherein the control condition corresponding to the determined drying level includes at least one of an operating frequency of the compressor and a temperature condition for on/off control of the compressor.

5. The clothes dryer of claim 4, wherein:

each of the plurality of categories has a high-load drying level and a low-load drying level defined corresponding to each category, and for each category, an operating frequency of the compressor corresponding to the high-load drying level is equal to or larger than an operating frequency of the compressor corresponding to the low-load drying level, or a temperature for on/off control of the compressor corresponding to the high-load drying level is equal to or larger than a temperature for on/off control of the compressor corresponding to the low-load drying level.

6. The clothes dryer of claim 5, wherein upon determining that the residual moisture content information about the drying item obtained by the moisture content detection circuit until the reference time elapses fails to reach less than the moisture content threshold, the controller is further configured to determine that the drying level of the drying item at a time when the reference time elapses is the high-load drying level of the determined category.

7. The clothes dryer of claim 5, wherein upon determining that the residual moisture content information about the drying item obtained by the moisture content detection circuit at a predetermined time before the reference time elapses reaches less than the moisture content threshold, the controller is further configured to determine that the drying level of the drying item at the predetermined time is the low-load drying level of the determined category.

8. The clothes dryer of claim 5, further comprising an input unit for setting a desired drying degree, wherein the controller is further configured to:

determine whether a preliminary termination condition is met based on a moisture content of the drying item and the set desired drying degree, when the preliminary termination condition is met, determine an additional drying time based on whether the determined drying level is the high-load drying level or the low-load drying level, and perform a cooling cycle after the main drying cycle is further performed for the additional drying time.

9. The clothes dryer of claim 1, further comprising a heat pump system configured to heat air introduced into an inside of the drum and including a compressor, a condenser, an expansion valve, and an evaporator, wherein each of one or more categories defined by a combination of one or more weight classifications having a higher range among the plurality of weight classifications and one or more residual moisture content classifications having a higher range among the plurality of residual moisture content classifications has a high-load drying level, a low-load drying level, and a special load drying level defined corresponding to each category, and wherein for each of the one or more categories, in an order of the high-load drying level, the low-load drying level, and the special load drying level, an operating frequency of the compressor corresponding to each is determined to be a previous level or less or, in an order of the high-load drying level, the low-load drying level, and the special load drying level, a temperature for on/off control of the compressor corresponding to each is determined to be a previous level or less.

10. The clothes dryer of claim 9, wherein upon determining that the residual moisture content information about the drying item obtained by the moisture content detection circuit until the reference time elapses fails to reach less than the moisture content threshold, the controller is further configured to determine that the drying level of the drying item at a time when the reference time elapses is the high-load drying level of the determined category.

11. The clothes dryer of claim 9, wherein upon determining that the residual moisture content information about the drying item obtained by the moisture content detection circuit at a first predetermined time before the reference time elapses reaches less than the moisture content threshold, the controller is further configured to:

determine whether the residual moisture content information about the drying item reaches less than a first predetermined value until a predetermined additional time elapses from the first predetermined time under a condition where the determined category belongs to the one or more categories, and upon determining that the residual moisture content information about the drying item fails to reach the first predetermined value until the predetermined additional time elapses, determine that the drying level of the drying item at a time when the predetermined additional time elapses is the low-load drying level of the determined category.

12. The clothes dryer of claim 9, wherein upon determining that the residual moisture content information about the drying item obtained by the moisture content detection circuit at a first predetermined time before the reference time elapses reaches less than the moisture content threshold, the controller is further configured to:

determine whether the residual moisture content information about the drying item reaches less than a first predetermined value until a predetermined additional time elapses from the first predetermined time under a condition where the determined category belongs to the one or more categories, and upon determining that the residual moisture content information about the drying item reaches less than the first predetermined value at a second predetermined time before the predetermined additional time elapses, determine that the drying level of the drying item at the second predetermined time is the special load drying level of the determined category.

13. The clothes dryer of claim 1, further comprising a heat pump system configured to heat air introduced into an inside of the drum and including a compressor, a condenser, an expansion valve, and an evaporator, wherein the drying level is one of n drying levels, where n is an integer equal to or larger than 2, sequentially defined from a first drying level to an nth drying level, an a-1th drying level being a higher level than an ath drying level, where a is an integer in a range of 1<a<=n, wherein an operating frequency of the compressor corresponding to the a-1th drying level is equal to or larger than an operating frequency of the compressor corresponding to the ath drying level, and wherein a temperature for on/off control of the compressor corresponding to the a-1th drying level is equal to or larger than a temperature for on/off control of the compressor corresponding to the ath drying level.

14. The clothes dryer of claim 1, wherein:

the drying level is one of n drying levels, where n is an integer equal to or larger than 2, sequentially defined from a first drying level to an nth drying level, an a-1th drying level being a higher level than an ath drying level, where a is an integer meeting 1<a<=n, and when the drying level determined for the drying item is one of a predetermined number of higher drying levels among the n drying levels, the controller is further configured to:

determine whether residual moisture content information about the drying item obtained by the moisture content detection circuit at a time when a second predetermined time elapses from the initiation of the main drying cycle reaches less than a second predetermined value, upon determining that the residual moisture content information about the drying item at the time when the second predetermined time elapses reaches less than the second predetermined value, change the drying level for the drying item into a lower level than the determined drying level, and perform a remaining main drying cycle according to a control condition corresponding to the changed drying level.

15. A method for controlling a drying operation of a clothes dryer, the clothes dryer including a drum configured to receive a drying item, a weight detection sensor configured to detect a weight of the drying item in the drum, a moisture content detection circuit configured to obtain residual moisture content information about the drying item in the drum, and a heat pump system including a compressor, the method comprising:

determining a category for the drying item among a plurality of categories based on the weight of the drying item detected by the weight detection sensor and the residual moisture content information about the drying item obtained by the moisture content detection circuit at a predetermined time after an initial drying cycle is initiated according to an initial control condition;

monitoring a reduction state in the residual moisture content information about the drying item obtained by the moisture content detection circuit based on a reference time and a moisture content threshold defined corresponding to the determined category to determine a drying level for the drying item; and controlling an operation of the compressor according to an operation condition of the compressor corresponding to the determined drying level to initiate a main drying cycle, wherein each of the plurality of categories is defined by a combination of a plurality of weight classifications defined per a weight range of the drying item and a plurality of residual moisture content classifications defined per residual moisture content information range of the drying item.

16. The method of claim 15, wherein:

each of the plurality of categories has a first drying level and a second drying level defined corresponding to each category, wherein one or more categories among the plurality of categories further have a third drying level defined corresponding to a respective category, for each category, an operating frequency of the compressor corresponding to the first drying level is equal to or larger than an operating frequency of the compressor corresponding to the second drying level, or a temperature for on/off control of the compressor corresponding to the first drying level is equal to or larger than a temperature for on/off control of the compressor corresponding to the second drying level, and for each of the one or more categories, an operating frequency of the compressor corresponding to the second drying level is equal to or larger than an operating frequency of the compressor corresponding to the third drying level, or a temperature for on/off control of the compressor corresponding to the second drying level is equal to or larger than a temperature for on/off control of the compressor corresponding to the third drying level.

17. The method of claim 16, wherein determining the drying level includes:

when the determined category does not belong to the one or more categories, upon determining that the residual moisture content information about the drying item obtained by the moisture content detection circuit until the reference time elapses fails to reach less than the moisture content threshold, determining that the drying level of the drying item at a time when the reference time elapses is the first drying level of the determined category; and upon determining that the residual moisture content information about the drying item obtained by the moisture content detection circuit at a predetermined time before the reference time elapses reaches less than the moisture content threshold, determining that the drying level of the drying item at the predetermined time is the second drying level of the determined category.

18. The method of claim 16, wherein determining the drying level includes:

when the determined category belongs to the one or more categories, upon determining that the residual moisture content information about the drying item obtained by the moisture content detection circuit until the reference time elapses fails to reach less than the moisture content threshold, determining that the drying level of the drying item at a time when the reference time elapses is the first drying level of the determined category; and upon determining that the residual moisture content information about the drying item obtained by the a moisture content detection circuit at a first predetermined time before the reference time elapses reaches less than the moisture content threshold, determining whether the residual moisture content information about the drying item reaches less than a first predetermined value until a predetermined additional time elapses from the first predetermined time, determining at a time when the predetermined additional time elapses that the drying level of the drying item is the second drying level of the determined category if the residual moisture content information about the drying item fails to reach less than the first predetermined value until the predetermined additional time elapses, and determining at a second predetermined time that the drying level of the drying item is the third drying level of the determined category if the residual moisture content information about the drying item reaches less than the first predetermined value at the second predetermined time before the predetermined additional time elapses.

19. The method of claim 15, further comprising:

obtaining a desired drying degree;

determining whether a preliminary termination condition is met based on a moisture content of the drying item and the desired drying degree;

determining an additional drying time based on the determined drying level when the preliminary termination condition is met; and performing a cooling cycle after further performing the main drying cycle for the additional drying time.

* * * * *